US008282367B2

(12) United States Patent
Ihle et al.

(10) Patent No.: US 8,282,367 B2
(45) Date of Patent: Oct. 9, 2012

(54) CENTRIFUGAL PUMP

(75) Inventors: Olai Ihle, Eckental (DE); Thomas Peterreins, Nuernberg (DE); Helmut Schmidt, Fuerth (DE); Armin Suttner-Reimann, Schwabach (DE)

(73) Assignee: Bühler Motor GmbH, Nürnberg (DE)

( * ) Notice: Subject to any disclaimer, the term of this patent is extended or adjusted under 35 U.S.C. 154(b) by 1038 days.

(21) Appl. No.: 11/790,820

(22) Filed: Apr. 27, 2007

(65) Prior Publication Data

US 2007/0286723 A1 Dec. 13, 2007

(30) Foreign Application Priority Data

Apr. 28, 2006 (DE) ..... 10 2006 021 243

(51) Int. Cl.
*F04B 35/04* (2006.01)

(52) U.S. Cl. ..... 417/423.8; 417/423.14; 310/86

(58) Field of Classification Search ..... 417/423.7, 417/423.1, 366, 423.8, 423.14; 310/54, 64, 310/71, 86, 257
See application file for complete search history.

(56) References Cited

U.S. PATENT DOCUMENTS

| | | | | |
|---|---|---|---|---|
| 6,036,456 | A * | 3/2000 | Peters et al. | 417/423.14 |
| 6,091,174 | A * | 7/2000 | Genster | 310/54 |
| 6,229,240 | B1 * | 5/2001 | Kech et al. | 310/86 |
| 6,365,998 | B1 * | 4/2002 | Kech et al. | 310/71 |
| 6,524,083 | B2 | 2/2003 | Deai et al. | |
| 6,896,494 | B2 * | 5/2005 | Sunaga et al. | 417/423.1 |
| 2004/0037719 | A1 * | 2/2004 | Sunaga et al. | 417/423.8 |
| 2004/0062664 | A1 * | 4/2004 | Weigold et al. | 417/357 |

* cited by examiner

*Primary Examiner* — Peter J Bertheaud
(74) *Attorney, Agent, or Firm* — Jacobson Holman PLLC

(57) ABSTRACT

A centrifugal pump with an existing pump housing made of plastic material that can be processed through injection molding, the pump housing having a first housing section featuring a suction nozzle and a pressure nozzle, a second housing section supporting an electronically commutated DC motor and a split case, a motor housing section that closes a dry chamber separated from a wet chamber by the split case in which a stator and electronic components are arranged, and a permanent magnet rotor that is mounted in the wet chamber in such a way that it can rotate, thereby driving a pump impeller that reaches into the pump chamber. The electronic components are arranged on an electronic circuit board parallel to a base of the split case. The electronic circuit board is in heat conducting contact with the base.

5 Claims, 9 Drawing Sheets

CENTRIFUGAL PUMP

BACKGROUND OF THE INVENTION (1) Field of the Invention

The invention is related to a centrifugal pump with a pump housing made of plastic material that can be processed through injection molding having a first housing section containing a suction nozzle and a pressure nozzle, a second housing section supporting an electronically commutated DC motor and having a split case, a motor housing section that closes a dry chamber which is separated from a wet chamber by the split case and in which a stator and an electronic component are arranged, and a permanent magnet rotor mounted in the wet chamber in such a way that it can rotate and drive a pump impeller stretching into the pump chamber. The electronic components are arranged on an electronic circuit board aligned at right angles to an axle and parallel to a base of the split case, and the electronic circuit board is in heat conducting contact with the base.

(2) Description of the Related Art

A generic centrifugal pump is known from U.S. Pat. No. 6,524,083 B2, in which several transistors are coupled thermally to the base of a pump chamber. A disadvantage of this design is the low heat conductance of the component housing and the difficult-to-guarantee flat support of the component on the base.

The task of the present invention is to cool heat-sensitive electronic components in a simple way and with a high degree of efficiency, so that a simple installation of the electronic units is guaranteed, only a small number of components is required, and the installation space is as small as possible.

BRIEF SUMMARY OF THE INVENTION

According to the invention, this problem is solved as follows: one or more conductors of the electronic circuit board are in heat conducting contact with the base. Electronic components pass on the heat generated in them first to the conductors connected to them directly; bringing these conductors in heat conducting contact with a heat sink can be very effective. The heat sink in this context is the base of the split case. Thus, no additional cooling bodies are required.

To establish a good thermal coupling between the surface of the electronic circuit board and the base, it makes sense to arrange a heat conducting element that fits the surface between the electronic circuit board and base. A particularly advantageous method is to arrange the heat conducting element fitting the surface of the conductors and the base between the base and the conductors.

This arrangement ensures an exceptional heat discharging effect by virtue of the fact that the heat originating in an electronic component is discharged to the circulation medium of the centrifugal pump through the conductors of the electronic circuit board, the heat conducting medium and the base of the split case.

An appropriately larger area is available for heat conduction if several components are used. In one variant therefore, at least three transistors are coupled thermally with the base as electronic components. The heat conducting element is preferably a heat conducting foil. Heat conducting foils can be mounted easily and securely.

In a preferred further embodiment of the centrifugal pump, the electronic circuit board has conductors whose cross sections are selected differently depending on the electrically and thermally connected components or component connections, so that a bigger cross section is selected if the expected heat development is larger. The larger cross sections can be used to discharge more heat to the surroundings. Normally, electronic circuit boards are provided with a copper lamination. Very little space is generally available on an electronic circuit board arranged in a housing that can serve as a cooling surface. The conductors are therefore designed according to requirement and for components or component connections that are known to have a large heat development, one must normally equip the coil current guiding components with a maximum possible large conductor cross-section, so that the heat can be discharged quickly.

In the same way, it is preferred that the electronic circuit board have conductors whose surface expansion on the electronic circuit board is selected according to the components or component connections linked to them electrically or thermally.

A bigger surface expansion is selected if the heat generation is expected to be bigger. The same principle is applicable here as the one mentioned above in which the surface or horizontal expansion of the conductors is also considered in addition to the cross-sections. In the optimal case, large conductor cross-sections are provided over a large conductor length.

The direct heat coupling of the conductors on the base according to the invention is possible only if components on the electronic circuit board do not cause any disturbance. In a preferred further development of the invention therefore, it is provided that at least one electronic component to be cooled is arranged on the side of the electronic circuit board facing the base, and is connected to the conductors on the opposite side of the electronic circuit board through at least one heat conducting open drilling.

A number of open drillings are provided to achieve an optimal heat coupling between the two electronic circuit board sides. Open drillings of this type are known from High Frequency (HF) technology. A large number of open drillings having small dimensions are used there to maintain an electromagnetic shielding for high frequencies.

In an alternative design model, a depression is provided in the base which serves as an opening for an electronic component arranged on the electronic circuit board and connected electrically and thermally to the electronic circuit board with the help of conductors. Normally the depression is provided only in the center of the base. Sufficient axial clearance is available there and this space can be used for the electronic component and the depression. A direct thermal coupling of the electronic component in the depression would be desirable, but is not provided on account of component tolerances.

A space saving electronic circuit can be achieved by designing the electronic components as SMD component and by soldering the surface of the conductors to the electronic circuit board without connecting wires. As the height of the SMD components is low, a correspondingly flat depression can also be selected. The component is e.g., an integrated circuit that controls the stator coil.

BRIEF DESCRIPTION OF THE DRAWINGS

A design model of the presented invention is explained in greater detail with the help of the drawings as follow.

DETAILED DESCRIPTION OF THE INVENTION

Figure 1:
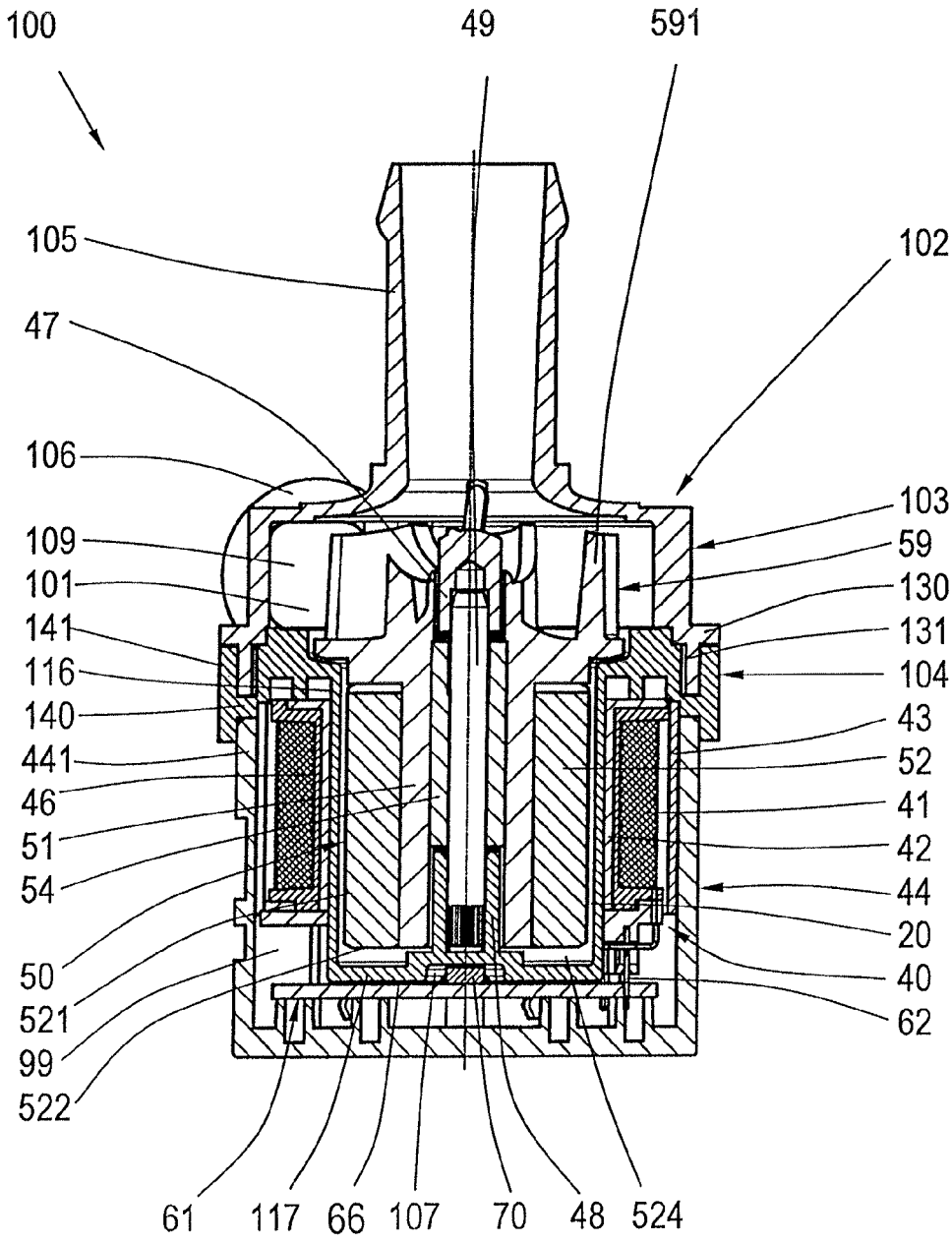
FIG. 1. A sectional view of a centrifugal pump according to the invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

Figure 10:
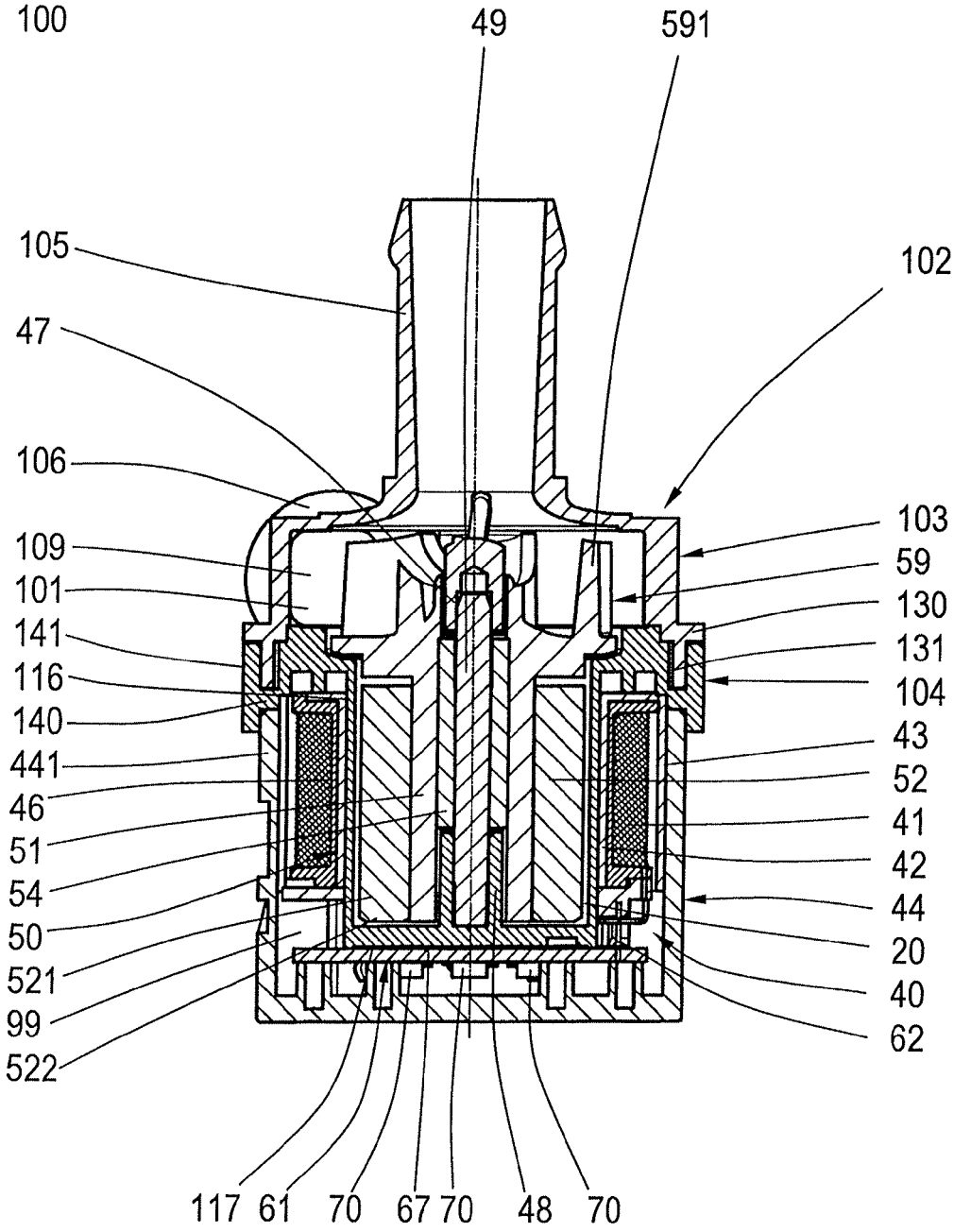

FIGS. 1 and 10 show a sectional view of a centrifugal pump 100 according to the invention with a pump housing 102 consisting of a first housing section 103 and a second housing section 104 attached to it. A motor housing section 44 limits a dry chamber which is occupied by a stator 40 of an electronically commutated DC motor and its triggering electronics. The motor housing section 44 closes the second housing section 102. The first and second housing sections 103, 104 limit a wet chamber 101 of the centrifugal pump. The second housing section 104 is integrated into a single piece with a split case 116, which separates the wet chamber 101 from a dry chamber 99.

The wet chamber 101 contains an axle 49 which is mounted permanently between a split case-side axle support 48 and a suction nozzle side axle support 47. A bordering at the axle end prevents the axle 49 from rotating when the pump is under operation. A locating bearing 54 is mounted on the axle 49 in such a way that it can rotate, which is pressed into a hollow shaft 51 of the rotor 50. The shaft 51 is integrated into one piece with a pump impeller 59 that contains several app. spiral shaped wings 591 for pumping the liquid. The front surface of the locating bearing 54 can be supported axially by an intermediate layer of start disks against the split case side axle support 48 and against the suction nozzle side axle support 47. A hollow cylindrical Ferrite magnet 52 is pasted on the hollow shaft 51. An elastic adhesive is used which is guided into three four or five grooves 511 designed in the hollow shaft parallel to the axle.

The dry chamber 99 contains the stator 40 of the electrically commutated DC motor 10, which is designed in the form of a hollow cylindrical stator coil 41. Its magnetic field is guided alternately to the periphery of the split case 116 through claw poles and it interacts with the hollow cylindrical permanent magnet 52 in the wet chamber 101. The magnetic circuit is closed with the help of a return ring 43, which is connected to the claw poles 42. The claw poles 42 are provided with an insulating body 46 through insertion molding, which connects the claw poles 42 mechanically but not magnetically. In the current example, the stator 40 has four pole pairs.

The insulating body 46 has a geometrical shape created in such a way that the wires of the stator coil 41 can be connected to contact pins 62 having clamping cut contacts. These clamping cut contacts can be mounted on the insulating body 46. The contact pins 62 are designed as combination contacts and their ends opposite the clamping cut contact 63 are pressed into an electronic circuit board 61, and thus contacted with it. The contact pins 62 contain one or two deformable pressing zones for this purpose. The electronic circuit board 61 is equipped with a hall sensor 71, at least one electronic component 70 for the coil wiring and a PTC for coil protection, and male connector pins 64 for the voltage supply. The motor housing section 44 contains a male connector housing 65 in which male connector pins 64 are arranged.

Heat is generated in the electronic circuit board 61 and hence it is coupled thermally to the base 117 of the split case 116 to discharge the heat to the circulation medium of the centrifugal pump.

A first design model of this heat discharge is displayed in FIGS. 1-9. Here, conductors 66 of the electronic circuit board are in direct contact with the base 117 through a heat conducting foil 67. An electronic component 70 in the form of an integrated circuit (IC) would have prevented this direct coupling with the base. A depression 107 has therefore been created in the split case into which the component can dip. The design according to FIG. 1 is not optimized for construction space. However, one can provide openings in the shaft 51 for the depression 107 of the base 117 in such a way that no construction space is lost by virtue of the described first design model of the invention.

The position of the electronic component 70 however is then defined at the center of the electronic circuit board. The conductors 66 that establish contact with component 70 to be cooled are dimensioned in such a way that the conductors 66 of the maximum possible width are provided on the electronic circuit board 61 for easy heat discharge. To achieve an excellent utilization of the electronic circuit board 61 and an optimal heat discharge, the different conductors 66 have different widths depending on the amount of heat generated in the component connection to be contacted. The large surface of the conductors 66 can be coupled thermally with the base 117 efficiently.

A longitudinal groove is designed in the shaft 51 of the rotor 50 as a cooling channel between a base 117 of the split case 116 and the pump impeller 59 which ensures a continuous circulation of the pumping medium even in the inner area of the split case 116. The electronic circuit board is arranged between a front side 45 of the motor housing 44 and the base 117 of the split case 116, and maintained in heat conducting contact with the base 117 through the heat conducting foil 67.

The first housing section 103 has a first flange 130 and a first ring 131 attached to it. The second housing section 104 has a second flange 140 and a second ring 141 attached to it. The motor housing section has a third ring 441. The second flange 140 and the second ring 141 assume a T shape together cross-sectionally. There are four sealing areas 133, 144, 145 and 444. The first sealing area is located radially on the outer side of the first ring 131 on the first housing section 103. The second sealing area 144 is located on the opposite, radially inner side of the second ring 141 and the second housing section 104. The third sealing area 145 is also located radially on the inner side of the second ring 141 and the second housing section 104. The fourth sealing 444 area is located on the opposite, radially outer side of the third ring 441 and the motor housing section 44. The second housing section 104 consists of a permeable medium for laser light of a particular wavelength or wavelength range.

The first housing section 103 and the motor housing section 44 consist of the same laser light absorbing material. This enables a laser beam to guided to a seam without heating the transparent material. There the beam encounters material that absorbs the light and converts it into heat which melts the plastic material and thus creates an inner connection with the neighboring material. As the two sealing areas to be welded are close to each other, one can create both seams in one device and in one operation without any difficulty. The welding device can have two individual lasers and one welded seam can be created with each laser beam, or it can have only one laser beam whose output beam is divided into two beams with the help of a splitter, and each beam can be used to create one welded seam. In the example in question, the laser rays fall radially on the pump housing.

Figure 2:
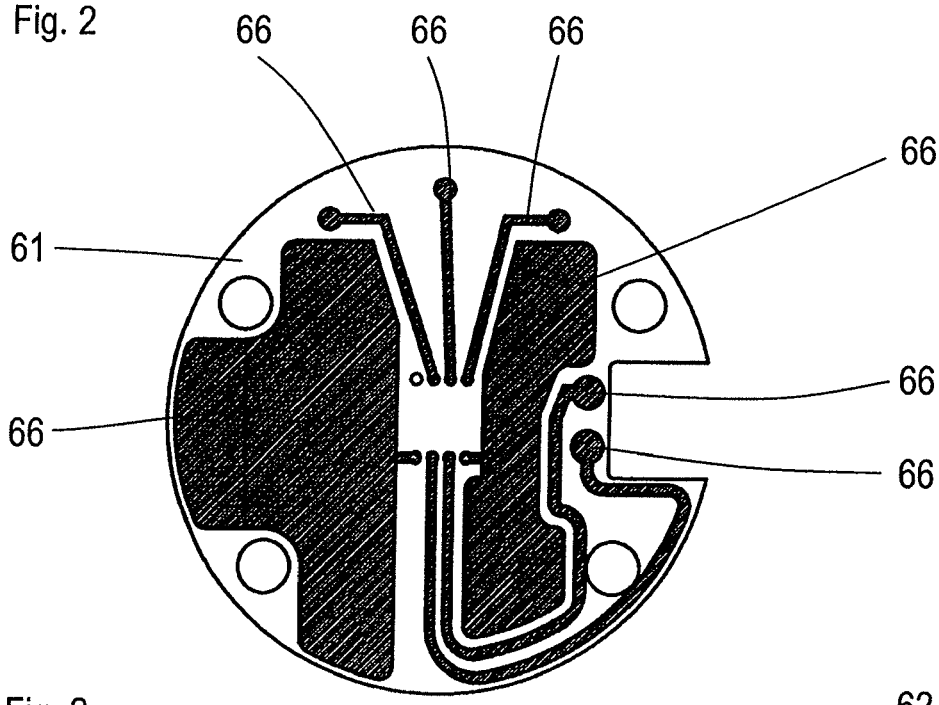
FIG. 2 An electronic circuit board layout.
Figure 3:
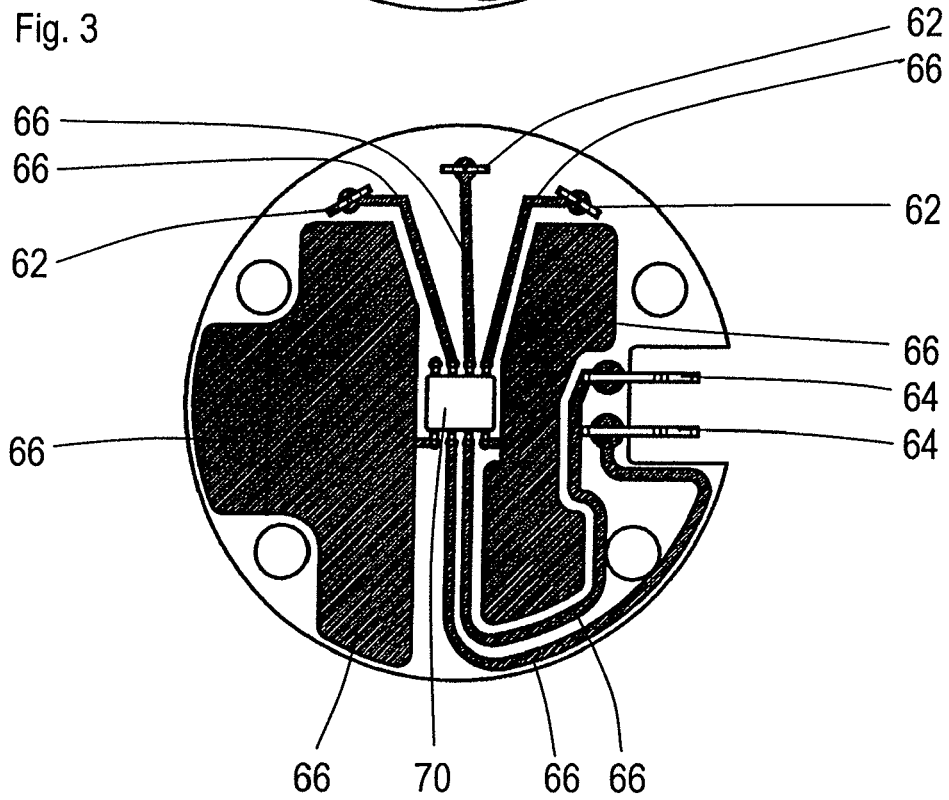
FIG. 3. A partially loaded electronic circuit board layout.

FIG. 2 shows the layout for an electronic circuit board 61 with conductors 66. FIG. 3 shows a partially equipped electronic circuit board layout of the electronic circuit board 61 with the integrated circuit 70 (IC) whose connecting contacts are attached electrically and thermally through different conductor ranges 66 having different surface expansions. Male connector pins 64 and contact pins 62 are also displayed.

Figure 4:
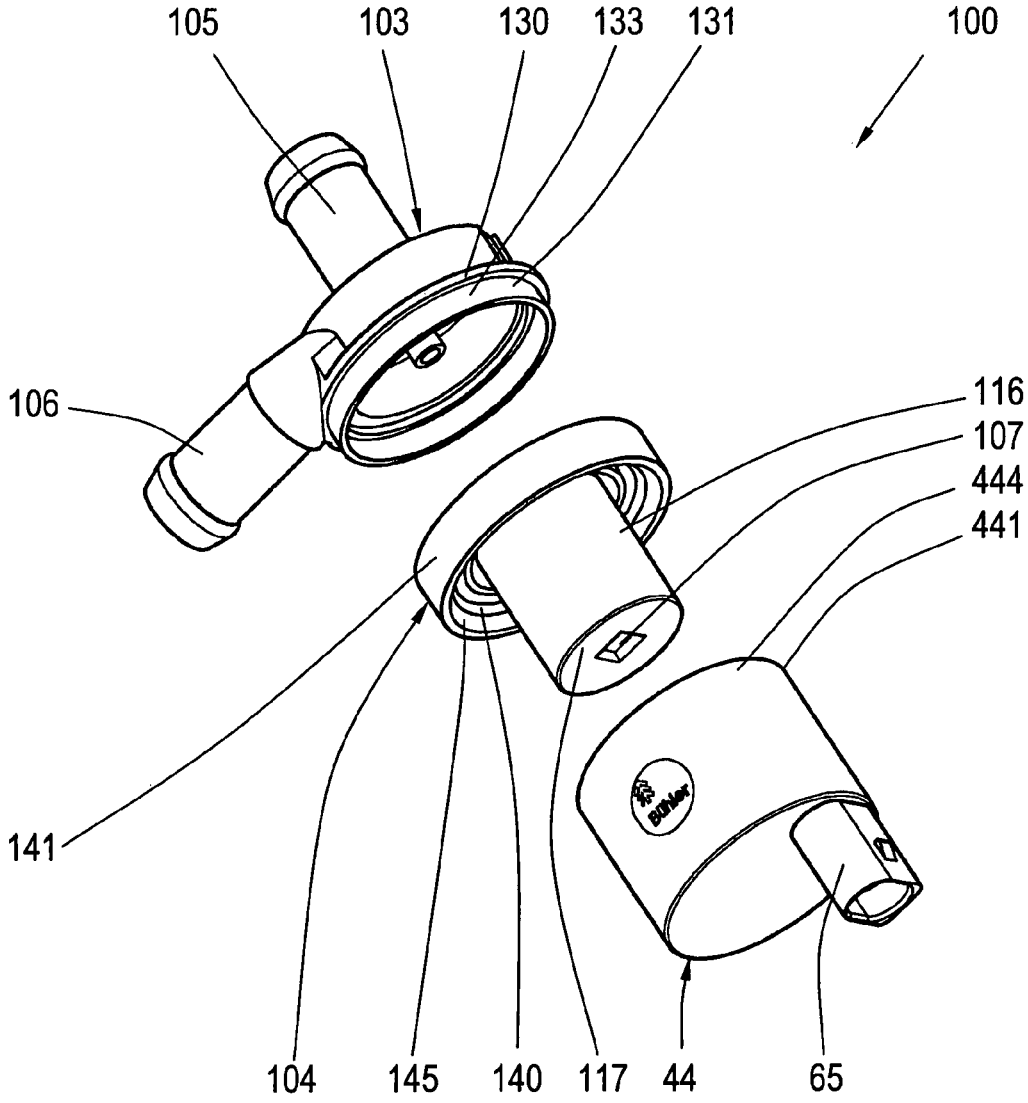
FIG. 4. An exploded view of the housing of the centrifugal pump.

FIG. 4 illustrates an explosion display of the centrifugal pump 100 housing with the first housing section 103, the second housing section 104 and the motor housing section 44. The first housing section 103 has a suction nozzle 105, a pressure nozzle 106, the first flange 130 and the first ring 131 that is connected to the first flange 130 and that has a sealing area 133. The second housing section covers the split case 116 having a depression 107 for an electronic component on its base 117, the second flange 140 and the second ring 141, which has the second sealing area 144 (not shown here) and the third sealing area 145 on its inner side. The motor housing section 44 covers the third ring 441, the fourth sealing area 444 and a male connector housing 65.

Figure 5:
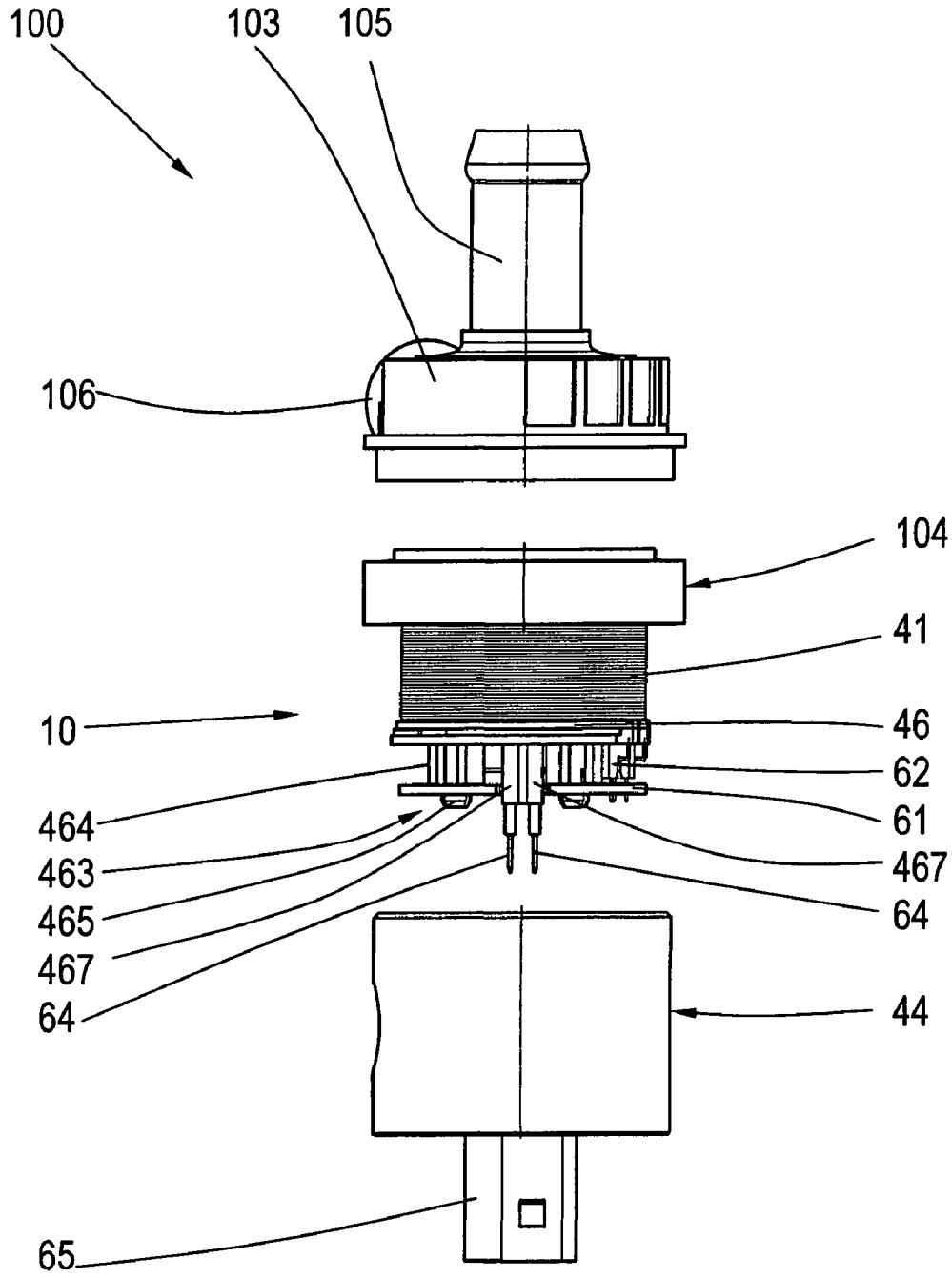
FIG. 5. An exploded view with a stator of a DC motor without brushes.

FIG. 5 illustrates an explosion display with a stator 40 of a DC motor 10 without brushes having the first housing section 103, the second housing section 104 and the motor housing section 44. The second housing section supports the stator 40 with a stator coil 41 wound on an insulating body 46.

There is a mounting medium 463 on the insulating body consisting of a stop material 464 and a snap-on device 465.

The stop 464 and the snap-on device 465 extrude from the insulating body 46. The fastening medium 463 mount the electronic circuit board 61. The insulating body 46 has holders 467 that are meant exclusively for providing mechanical support to the male connector pins 64. The male connector pins are connected to the electronic circuit board 61 electrically. An electrical connection is established between the electronic circuit board 61 and the stator coil 41 by the contact pins 62. The contact pins 62 have insulation displacement contacts on the one hand and pressing contacts on the other.

Figure 6:
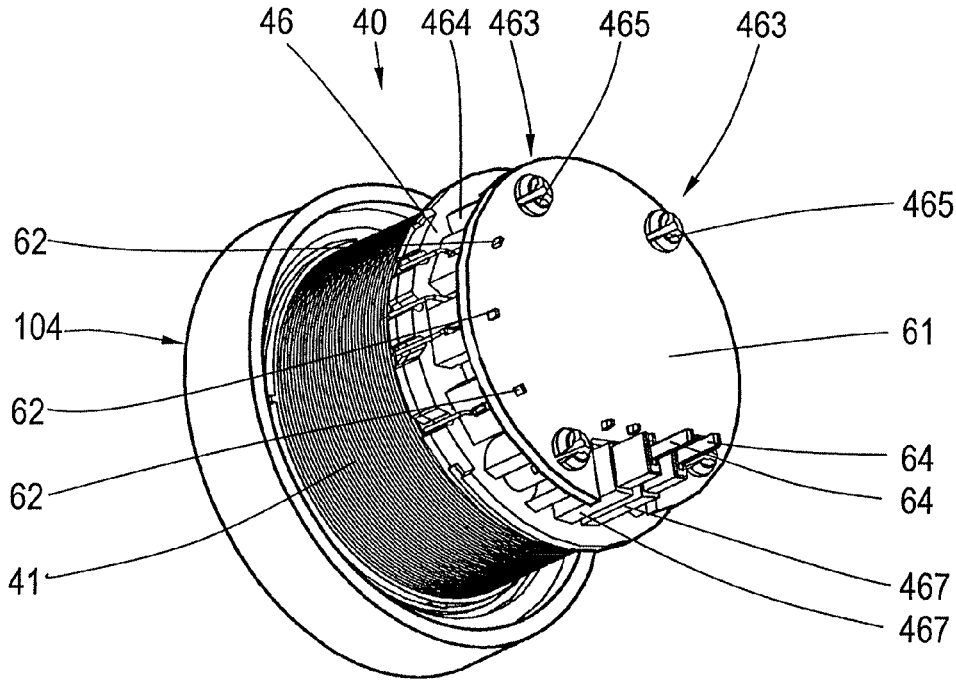
FIG. 6. A perspective view of the mounted stator.

FIG. 6 illustrates the mounted stator 40 with the second housing section 104 which is connected to the insulating body 46, the stops 464 and the snap-on devices 465 as mounting material 463 of the electronic circuit board 61, the holders 467 of the male connector pins 64 and the contact pins 62 that are pressed into the electronic circuit board and are connected to the stator coil 41 electrically through insulation displacement contacts.

Figure 7:
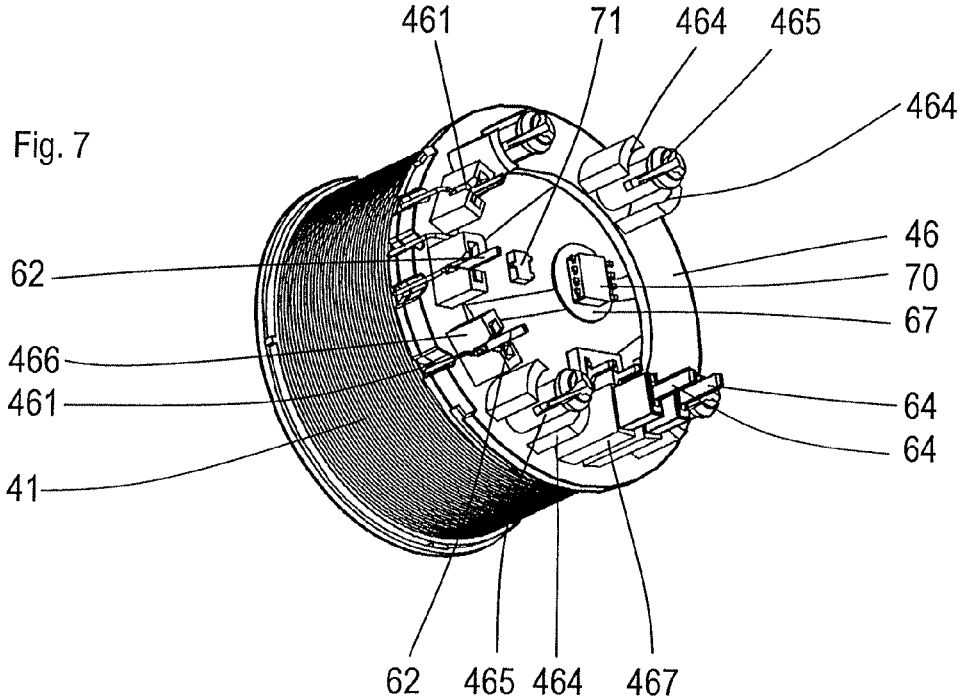
FIG. 7. A perspective view according to FIG. 5 with the electronic circuit board not displayed FIG. 8. A perspective view of the stator with hidden insulating body, FIG. 9. A second perspective view of the stator with hidden insulating body, FIG. 10. A sectional view of a second design model of the centrifugal pump, FIG. 11. An electronic circuit board of the second design model, and FIG. 12. An electronic circuit board with heat conducting foil.

FIG. 7 shows a display according to FIG. 6 with hidden electronic circuit board 61 in which the hall sensor 71 and the integrated circuit (IC) are represented in the correct position along with the heat conduction foil. One can view the contact pins 62 clearly here. These are inserted in the extrusions 466 and are connected there to a coil wire through insulation displacement contact. The coil wire is inserted into slots 461 of the extrusion. Further, the stops 464 that are provided two-fold for each mounting means 463 and slotted snap-on means 465 can be detected.

Figure 8:
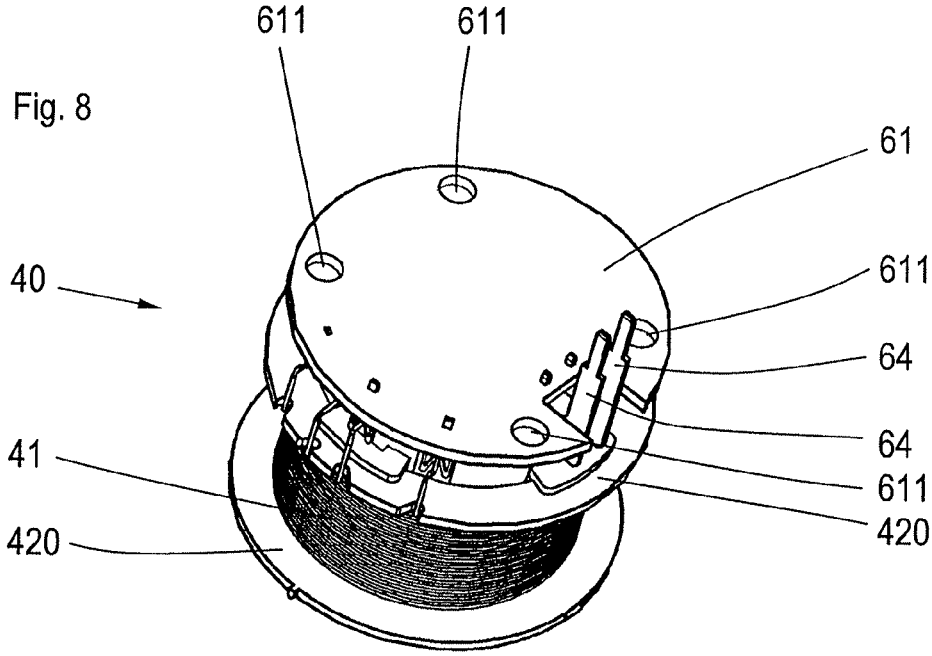
Figure 9:
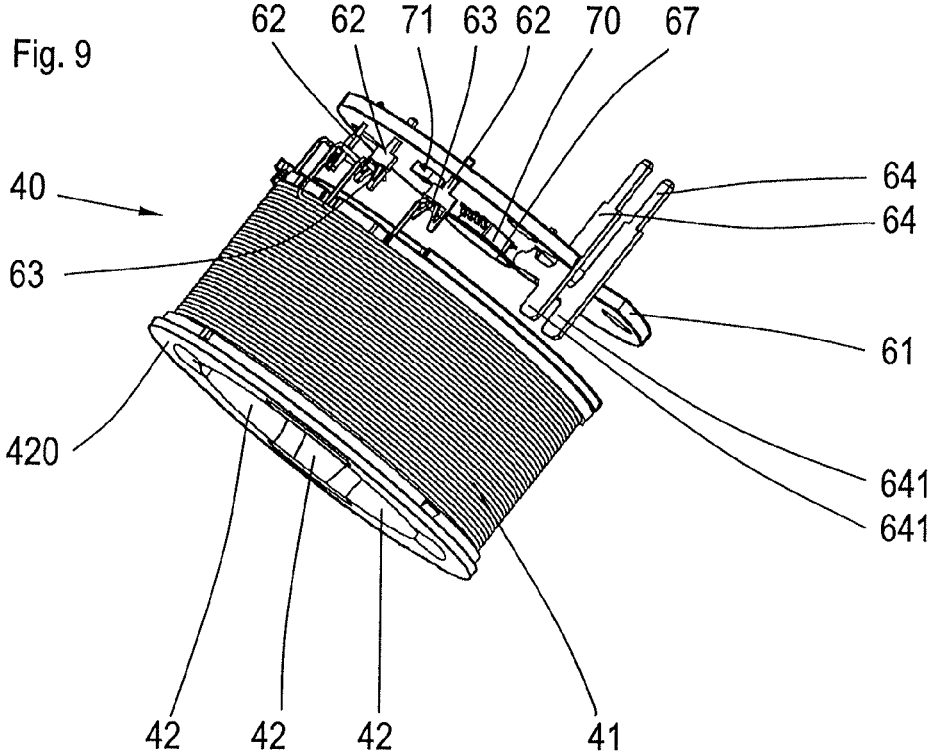

FIGS. 8 and 9 illustrate the stator 40 with ring disk shaped stator plates 420 to which claw poles 42 are connected, the stator coil 41, the electronic circuit board 61, the male connector pins 64 that are provided with formations 641 with the help of which they are fixed in the hidden insulation body, the integrated circuit (IC) 70 with heat conducting foil 67 and the hall sensor 71. In FIG. 8, the insulation displacement contacts 63 of the contact pines 62 can be viewed clearly. The electronic circuit board 61 has cutouts 611 that support the above mentioned snap-on devices.

FIG. 10 illustrates a second design model of the invention. The electronic components are arranged on the side opposite to the face 117. This way it is possible to design the components 70 as discrete transistors because the transistors are not located in depressions and can therefore be arranged over the entire surface of the electronic circuit board. A large number of drilled openings 612 are provided in the electronic circuit board 61 to direct the heat created in the component parts 70 to the base 117. Taken together, the drilled openings form a large conduction cross section and they can guide the heat in the conductors 66 of the electronic circuit board 61 side facing the components, and through them to the base 117. See FIG. 12 for an example of a planar heat conducting medium 67.

Figure 11:
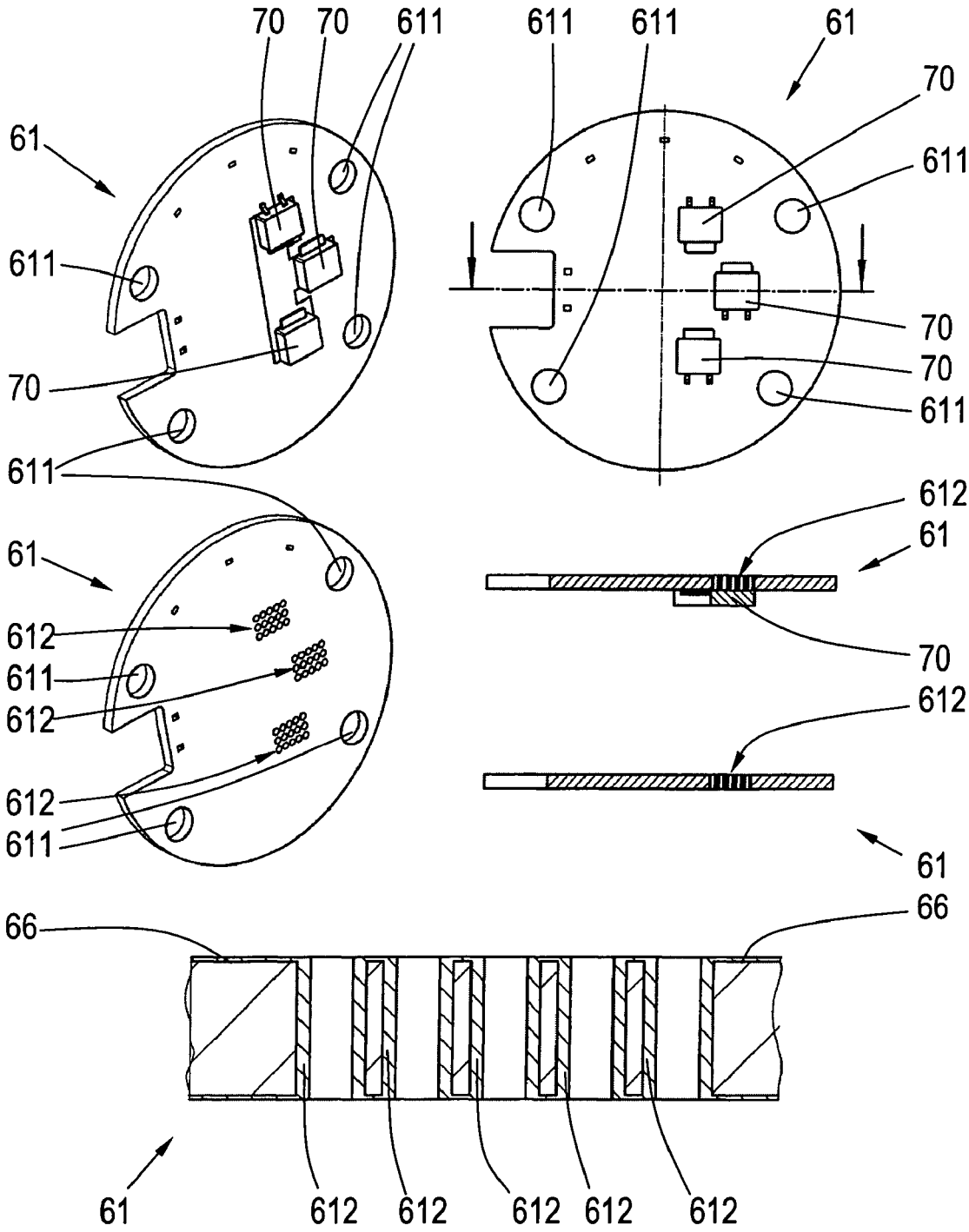

FIG. 11 shows an electronic circuit board 61 according to the second design model of the invention, having electronic components 70 in the form of transistors with cutouts 611 for supporting the electronic circuit board 61, conductors 66 and a large number of drilled openings 612, which conduct in large part the heat created in the electronic components 70 to the circuit board 61 side which is facing them, and from there via the conductors 66 to the base of the centrifugal pump and from there to the pump medium.

Figure 12:
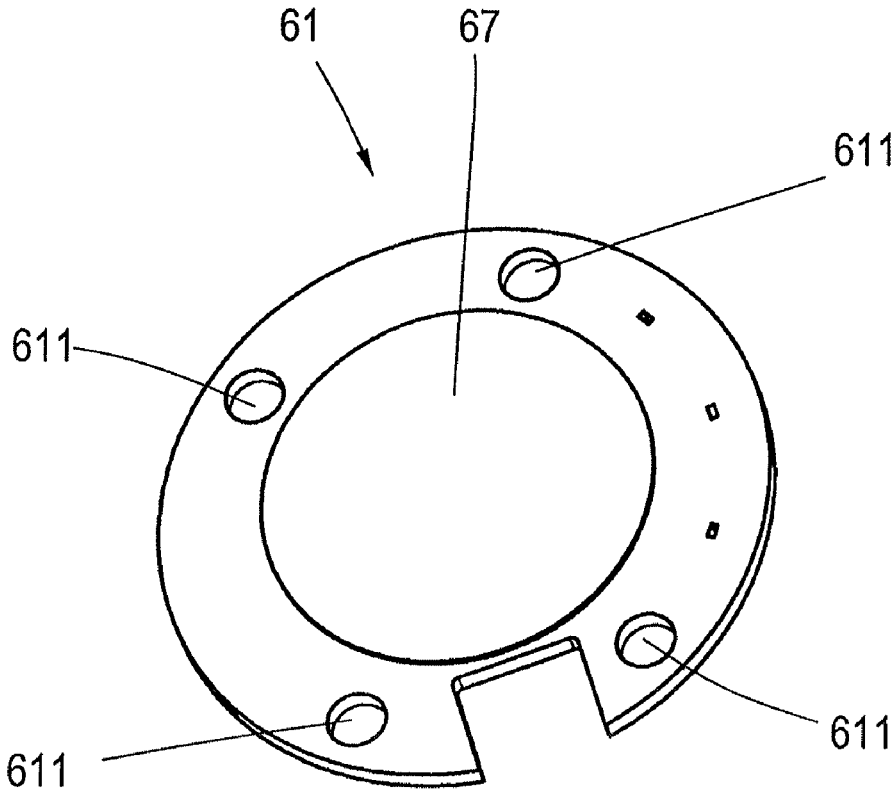

FIG. 12 shows an electronic circuit board 61 according to the second design model in which the electronic components 70 are close to the base. A heat conducting foil 67 is pasted on the conductors to improve the thermal coupling between the conductors and the base 117.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A centrifugal pump comprising:

a pump housing made up of a first housing section and a second housing section attached to the first housing section;

a suction nozzle and a pressure nozzle defined in the first housing section;

a wet chamber defined in the first and second housing sections;

a motor housing section which mates with the second housing section to define a dry chamber;

a split case separating the dry chamber and the wet chamber, the split case having a base;

an electronically commutated direct current motor having a stator mounted in the motor housing section;

an electronic circuit board arranged in the motor housing section, the electronic circuit board having a planar surface;

a pump chamber;

a pump impeller that extends to the pump chamber;

a permanent magnet rotor mounted in the wet chamber for rotating and driving the pump impeller;

an axle;

a plurality of electronic components arranged on the electronic circuit board parallel to the base of the split case;

one or more planar conductors disposed on the planar surface of the electronic circuit board;

a depression formed in the center of the base, the depression having a recessed wall; one of the plurality of electronic components being disposed within the depression; and a planar heat conducting medium disposed between the recessed wall and the electronic component disposed within the depression; wherein the electronic component disposed within the depression and the one or more planar conductors are in heat conducting contact with the base by way of the planar heat conducting medium.

2. The centrifugal pump according to claim 1, wherein the planar heat conducting medium is a heat conducting foil.

3. The centrifugal pump according to claim 1, wherein at least one of the plurality of electronic components is a surface-mount device and it is soldered to the surface of the one or more planar conductors of the electronic circuit board without connecting wires.

4. The centrifugal pump according to claim 1, wherein at least one of the plurality of electronic components is an integrated circuit.

5. The centrifugal pump of claim 1, wherein the pump housing is made of injection molded plastic.

* * * * *